United States Patent [19]

Kurek et al.

[11] Patent Number: 4,803,964

[45] Date of Patent: Feb. 14, 1989

[54] INTERNAL COMBUSTION ENGINE

[76] Inventors: Wladyslaw Kurek; Andrzej Startek, both of 2815 S. 49th Ave., Cicero, Ill. 60650

[21] Appl. No.: 940,289

[22] Filed: Dec. 11, 1986

[51] Int. Cl.[4] ..... F02B 75/32

[52] U.S. Cl. ..... 123/197 AC; 74/30; 74/437; 123/197 R

[58] Field of Search ..... 74/29, 30, 437; 123/58 A, 58 AA, 58 AB, 197 AB, 197 AC

[56] References Cited

U.S. PATENT DOCUMENTS

| | | | |
|---|---|---|---|
| 428,249 | 5/1890 | Harfield | 74/437 X |
| 798,847 | 9/1905 | Voss | 74/437 |
| 1,370,518 | 3/1921 | Christenson | 74/30 |
| 1,687,744 | 10/1928 | Webb | 123/197 R |
| 1,885,298 | 11/1932 | Schell | 74/30 |
| 2,008,958 | 7/1935 | Huffman | 74/30 |
| 2,274,097 | 2/1942 | Sheerer . | |
| 2,337,330 | 12/1943 | Julin . | |
| 3,135,166 | 6/1964 | Born . | |
| 3,356,080 | 12/1967 | Howard . | |
| 3,370,510 | 2/1968 | Bunyan . | |
| 3,375,022 | 3/1968 | Hattan | 280/238 |
| 3,901,093 | 8/1975 | Brille . | |
| 3,905,339 | 9/1975 | Wallis . | |
| 3,942,488 | 3/1976 | Phillips et al. . | |
| 3,945,358 | 3/1976 | Collins . | |
| 3,945,359 | 3/1976 | Asaga . | |
| 3,991,736 | 11/1976 | Spellman . | |
| 4,211,082 | 7/1980 | Bristol . | |
| 4,381,739 | 5/1983 | Fisher . | |
| 4,462,345 | 7/1984 | Routery . | |
| 4,465,042 | 8/1984 | Bristol . | |
| 4,497,284 | 2/1985 | Schramm . | |
| 4,526,141 | 7/1985 | Catchpole . | |
| 4,543,839 | 10/1985 | Buchanan, Jr. et al. | 74/98 |
| 4,608,951 | 9/1986 | White | 123/197 AC |

OTHER PUBLICATIONS

"Ingenious Mechanisms for Designers and Inventors," The Industrial Press, pp. 260–262, (F. D. Jones, 1st Ed., 1930).

*Primary Examiner*—Samuel Scott
*Assistant Examiner*—Allen J. Flanigan
*Attorney, Agent, or Firm*—Willian Brinks Olds Hofer Gilson & Lione Ltd.

[57] ABSTRACT

An internal combustion engine comprising a piston slidably disposed for rectilinear reciprocal movement within a cylinder. A drive rack pivotally mounted to the piston carrys a continuous internally facing row of teeth. A drive gear nonrotatably keyed to a drive shaft and internally adjacent to the continuous row of teeth engages a portion of the drive rack teeth. A runner guides the drive rack such that the drive gear cooperatively associates with the drive rack teeth to convert rectilinear movement of the reciprocating piston into rotary movement. One or both of the drive gear and the drive rack are shaped in accordance with the variable forces exerted on the piston during its motion so as to apply torque more evenly to the crank shaft.

25 Claims, 3 Drawing Sheets

INTERNAL COMBUSTION ENGINE

BACKGROUND OF THE INVENTION

This invention relates to improved internal combustion engines More particularly, it relates to internal combustion engines having a crankless drive mechanism for converting reciprocal rectilinear movement into rotary movement.

A conventional commercially available internal combustion engine utilizes a crank shaft to transform a reciprocating piston motion into a rotary motion. As the piston moves within its cylinder in response to expanding gases of combustion, rotary motion is imparted to the crank shaft through a connecting rod. One end of the connecting rod is affixed to a wrist pin pivotally secured to the piston, while the other end is rotatably journaled about an offset throw of the crank shaft. When multiple cylinder arrangements are desired, the crank shaft is extended to include an additional offset throw for each piston connecting rod.

As the piston transmits force created by the combustion of fuel to the crank shaft by way of the connecting rod, the angularity of the connecting rod causes a considerable side thrust to be exerted by the piston on the walls of the cylinder. This angular thrust is generally absorbed by a skirt portion of the piston; that is, the section below the piston rings. This side thrust or angular force absorbs a portion of the linear energy and contributes to the inefficiency of the conversion of the linear movement of the piston into the rotary movement of the crank shaft.

In a conventional internal combustion engine, the crank shaft is supported by main bearings, and at the end of the crank throw, a crank pin holds the connecting rod. In order to compensate for energy lost to angular forces, the piston rod is lengthened and the crank throw is made longer than the radius of the cylinder bore. Thus, additional space must be allowed to accommodate the crank throw. In addition, to avoid a downward thrust of the piston while the piston is at the upper limit of the stroke (top dead center), the crank shaft or crank pin may be offset from the longitudinal center of the cylinder, or alternatively a timing mechanism may be employed to delay spark ignition in the combustion chamber. These factors further contribute to increased size of commercially available internal combustion engines.

Furthermore, the timing of fuel inlet and spark ignition is crucial in commercial spark ignited internal combustion engines Auto ignition or knocking may occur as a result of poor timing or variances in the quality of fuel. Attempts have been made to solve these problems by employing timing mechanisms to allow high pressures in the combustion chamber to be available when the crank throw is approximately 90 degrees into the power stroke. These timing mechanisms, however, have been unsuccessful.

In an attempt to improve upon the inefficiency of the conventional commercially available crank shaft engine, U.S. Pat. Nos. 3,356,080 and 3,370,510 disclose internal combustion engines which employ wobble plates to convert linear piston reciprocation into rotary movement. In such an engine, a number of cylinder piston units are disposed around a crank shaft with the lines of reciprocation of the pistons parallel to the axis of the crank shaft. Connecting rocker arms are disposed in general planes radial of the axis of the crank shaft Each rocker arm is engaged at its radially inner end with an inclined crank pin and at its radially outer end with a reciprocating part of one of the cylinder piston units Other internal combustion engines, having crankless drive mechanisms, have been suggested for converting the reciprocating rectilinear movement of pistons into rotary movement For example, U.S. Pat. Nos. 3,135,166, 3,901,093 and 4,497,284 disclose a swash plate in place of the crank shaft to directly convert the reciprocation of pistons to rotary movement In a swash plate, an output shaft is driven by a means of connecting rods which have simple clevis type attachments at both ends.

Another approach proposed by the prior art for replacing the conventional crank shaft is the cam internal combustion engine. For example, in U.S. Pat. No. 2,274,097, reciprocating rectilinear pistons impart rotation to a cam plate through wrist pin runners attached to the piston rod which reciprocates in guide grooves.

U.S. Pat. No. 2,337,330 discloses a crankless internal combustion engine containing a driving pinion and two gear wheels. Two power cylinders positioned on either side of a drive shaft contain a reciprocating piston having an attached rack. The teeth of the opposed racks mesh with the opposite sides of a pinion such that, as the pistons reciprocate, a drive shaft to which the pinion is attached alternately rotates in opposite directions. A driving pinion is attached to one end of the shaft and also rotates in opposite directions with the driving shaft. The alternate rotation is translated into a constant rotation in one direction by two segmental gear wheels which mesh with the driving pinion. Each gear wheel contains teeth projecting around a portion of its periphery so as to form a segment while the remaining portion of the periphery is blank. A mechanism is provided for disengaging the driving pinion from its mesh with one of the segments when the drive of the pinion to the other segment commences.

U.S. Pat. No. 4,465,042 discloses a crankless internal combustion engine wherein a connecting rod moves along in an essentially vertical line within a cam track. During the power stroke, the piston applies force to the rod which extends downwardly from the piston. The lower end of the rod is guided along a closed, curvilinear, vertically extending path as the piston reciprocates. A power output shaft is rotatably supported adjacent to and outside the cam track. A drive member is secured to the power output shaft and has a peripheral portion extending along the cam track As the lower end of the rod moves along the cam track, it carries a force transmitting member which engages the drive member transferring power to the output shaft.

The prior art crankless internal combustion engines contain multiple moving parts which increase the amount of energy lost to frictional forces and wear and tear. To the best knowledge of the inventors of the present invention, these prior art crankless engines have therefore not been commercially successful. Thus, the conventional commercially available reciprocating piston engines are inefficient energy transfer devices because of their loss of energy to angular forces, or because of energy lost to frictional forces and wear and tear.

There is therefore a long felt but still unsatisfied need for a commercially feasible internal combustion engine which converts a higher proportion of the linear energy of the piston into rotation energy than the conventional crank drive engines.

Accordingly, it is an object of the present invention to provide an internal combustion engine for efficiently converting the reciprocating movement of a piston into rotational movement A further object of the present invention is to provide an internal combustion engine which converts reciprocal movement into rotary movement while employing a minimum number of moving parts Another object of the present invention is to provide an internal combustion engine which is smaller in size and yet converts reciprocal movement of a piston into rotary movement more efficiently than commercially available engines.

A still further object of the present invention is to provide an internal combustion engine which reduces the amount of energy lost to angular and frictional forces when reciprocal linear energy is converted into rotational energy.

An additional object of the present invention is to provide an internal combustion engine which can burn a low quality fuel and yet efficiently convert the reciprocating movement of a piston into rotary movement.

Yet another object of the present invention is to provide an internal combustion engine which can experience autoignition, knocking, or detonation and still efficiently convert the reciprocating movement of a piston into rotary movement.

A further object of the present invention is to provide an internal combustion engine having parts which can be designed for the most efficient operation depending on the type or quality of fuel which is available for consumption.

A still further object of the present invention is to provide an internal combustion engine which is substantially more tolerable of imprecise timing of the burning of the fuel mixture during the power stroke of the piston than the conventional engines.

Still another object of the present invention is to provide an internal combustion engine which eliminates the need for costly and pollutive fuel additives.

A further object of the present invention is to provide a crankless internal combustion engine wherein the arm component is maintained at a maximum substantially through conversion of rectilinear movement of the piston into rotary movement.

An additional object of the present invention is to provide a crankless internal combustion engine which will burn fast burning fuels without the employment of fuel additives such as those used in conventional crank shaft engines to control or delay combustion in the combustion chamber.

A further object of this invention is to provide an internal combustion engine requiring less manufacturing costs, less repair and maintenance costs, while giving better overall performance and increased fuel economy than conventional commercially available internal combustion engines.

These and other objects of the present invention will become more apparent to those skilled in the art in view of the following disclosure.

SUMMARY OF THE INVENTION

In accordance with an aspect of the present invention, a crankless internal combustion engine is provided having a continuous internally facing force transfer means pivotally mounted to a piston and a means for guiding the force transfer means such that a drive means nonrotatably keyed to a drive shaft and internally adjacent to said force transfer means cooperatively associates with the force transfer means to convert rectilinear movement of the piston into rotary movement. The engine comprises a piston slidably disposed for rectilinear reciprocal movement within a cylinder. A continuous internally facing force transfer means is pivotally mounted to the piston A drive means which is nonrotatably keyed to a drive shaft and internally adjacent to the force transfer means, engages a portion of the force transfer means. A guiding means is located such that as the piston reciprocates within the cylinder, the drive means cooperatively associates with the force transfer means to convert the rectilinear movement of the piston into rotary movement of the drive shaft.

In accordance with still yet another aspect of the present invention, a crankless internal combustion engine having parts which can be designed for the most efficient operation depending on the type or quality of fuel available for consumption is also provided. A piston slidably disposed for rectilinear reciprocal movement within said cylinder has a continuous internally facing force transfer means pivotally mounted thereto. The shape of the force transfer means is designed in accordance with the variable forces applied to the piston during reciprocal movement of the piston within the cylinder. A drive means keyed to a drive shaft and internally adjacent to the force transfer means engages a portion of the force transfer means. The shape of the drive means may also be designed in accordance with the variable forces applied to the piston during reciprocal movement of the piston within the cylinder. A means for guiding the force transfer means such that the drive means cooperatively associates with the force transfer means to convert rectilinear movement of the piston into rotary movement is also provided.

In accordance with another aspect of the present invention, a crankless internal combustion engine containing a rack and gear assembly for converting reciprocating rectilinear energy into rotational energy is provided The engine of the present invention comprises a piston slidably disposed for rectilinear reciprocal movement within a cylinder. A drive shaft, having a drive gear nonrotatably keyed thereto, is disposed from the piston such that its longitudinal axis is substantially perpendicular to the longitudinal axis of the cylinder. A fixed runner block, defining a closed runner track, is disposed from the piston such that the drive shaft is interposed between the piston and runner block member. A drive rack having an upper end pivotally mounted to the piston and a lower end slidably mounted to the runner track is disposed substantially perpendicular to the longitudinal axis of the drive shaft. The drive rack contains a continuous internally facing row of teeth which mesh with at least a portion of the drive gear teeth such that the rectilinear movement of the piston is transferred to rotary movement of the drive shaft.

In operation, during the power stroke of the piston, the drive rack is driven in a substantially parallel path with respect to the longitudinal axis of the cylinder. As the drive rack moves, a runner pin which slidably mounts the lower end of the drive rack to the runner track, moves along the runner track causing the drive rack to pivot slightly at the upper pivotal mounting. As the piston continues its downward thrust, the internally facing drive rack teeth engage with the drive gear teeth causing the drive gear and keyed drive shaft to rotate. As the piston reciprocates in the opposite direction of the power stroke (return stroke), the drive rack is carried with it, and the runner following the runner track causes the drive rack to once again slightly pivot at the pivotal mounting. As the piston returns to the top of the stroke position, the drive rack teeth remain engaged with the drive gear teeth, maintaining the rotary motion of the drive gear and drive shaft. When the piston reaches the top stroke position, the runner will be positioned at the upper most portion of the runner track, the lower most portion of the row of drive rack teeth will be engaged with the drive gear teeth, and another cycle may begin.

DETAILED DESCRIPTION OF THE INVENTION

Figure 1:
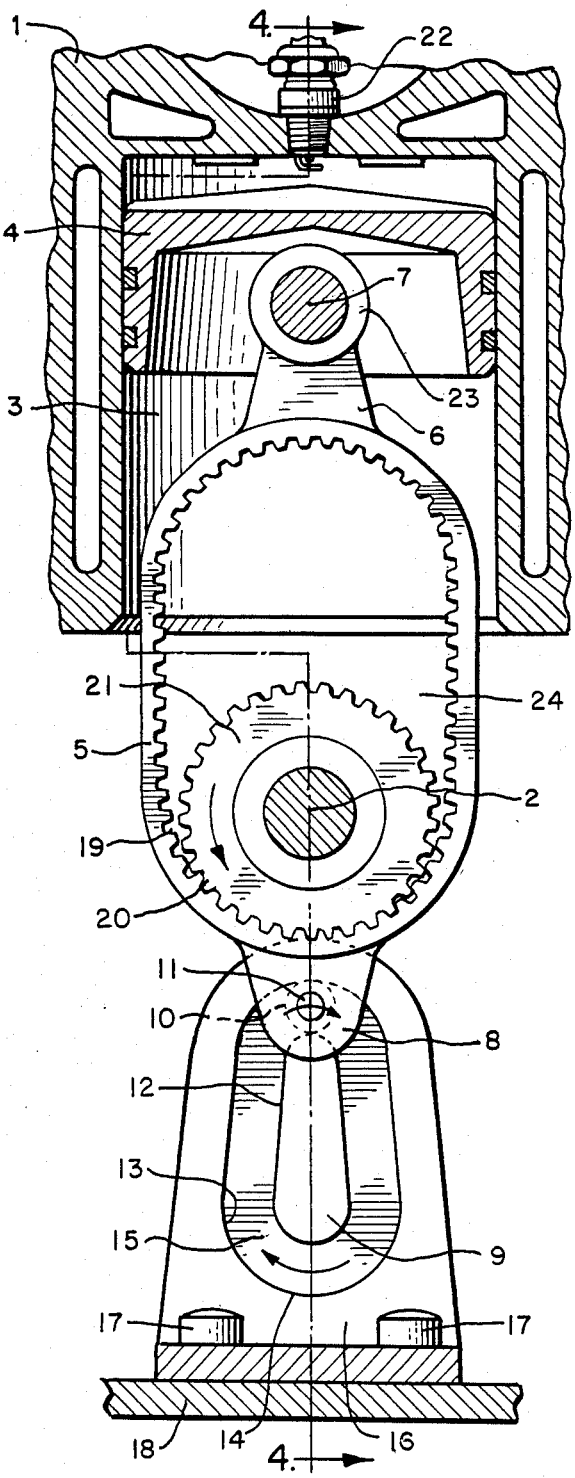
FIG. 1 is a front sectional view (taken from line 1—1 of FIG. 4) of a rack and gear assembly of an internal combustion engine constructed in accordance with the present invention wherein the assembly is about to begin a driving cycle.

It has now been discovered that when a force transfer means, pivotally mounted to a piston, is guided such that it travels substantially parallel to the rectilinear power stroke of the piston while engaging a drive means which causes a drive shaft to rotate, many of the problems experienced by commercial crank drive internal combustion engines are alleviated. The force transfer means may be constructed of any rigid material which will transfer the rectilinear energy of the piston to rotary energy. The force transfer means may be carried on a rack or other suitable element which is pivotally mounted to the piston. The force transfer means preferably is a continuous closed loop, and is internally facing such that it surrounds or encompasses the drive shaft. The shape of the force transfer means may be symmetrical or asymmetrical, and may be designed in accordance with the rate of reciprocal movement of the piston within the cylinder. Preferably, the force transfer means is a continuous internally facing row of teeth carried by a drive rack. The teeth may be arranged as two opposed linear segments and two opposed semicircular or semicylindrical segments.

The internally facing force transfer means also preferably surrounds or encompasses a drive means and continuously engages at least a portion of the drive means as the piston reciprocates. The drive means may be any rigid element which is internally adjacent to the force transfer means and will actively engage the force transfer means as the force transfer means is powered by the reciprocating piston. The drive means may be generally cylindrically shaped and may be designed in accordance with the rate of reciprocal movement of the piston within the cylinder. Preferably, the drive means is a drive gear or pinion having teeth which engage with the force transfer means. As the piston reciprocates, the force transfer means will preferably continuously contact a peripheral portion of the drive means. The drive means is nonrotatably keyed to a drive shaft which is the rotary power output.

A guiding means is further provided to guide the force transfer means such that the drive means cooperatively associates with the force transfer means to convert the rectilinear movement of the piston to rotary movement of the drive shaft. Preferably, the guiding means guides a drive rack carrying the force transfer means such that during the power stroke of the piston, the force transfer means travels substantially parallel to the rectilinear movement of the piston as it engages the driving means. More preferably, the force transfer means contains at least one substantially linear segment and the drive means engages the substantially linear segment of the force transfer means during the power stroke.

Contrary to commercial engines employing crank drives, the force transfer means in accordance with the present invention is substantially parallel to the longitudinal axis of the cylinder bore. This arrangement provides for maximum conversion of rectilinear movement of the piston into rotary movement by eliminating angular forces. Furthermore, the number of moving parts is minimal, eliminating energy lost to frictional forces. Thus, the present invention allows the central longitudinal axis of the drive shaft to intersect the central longitudinal axis of the cylinder and still maintain maximum conversion of rectilinear movement of the piston to rotary movement of the drive shaft.

Furthermore, since the drive shaft and drive means are internal to the force transfer means at all times, the guide means allows the pivot angle of the force transfer means or any drive rack which carries said means to be considerably less than the pivot angle of a connecting rod in a commercial crank shaft drive mechanism.

Those skilled in the art will readily recognize that a circular shaped drive means will provide a constant, maximum arm component and thus maximum torque substantially throughout the conversion of rectilinear movement of the piston to rotary movement In accordance with the present invention, therefore, maximum torque is reached early in and maintained substantially throughout the power stroke of the piston. In commercial crank shaft engines, the arm component increases during the power stroke, reaches a maximum when the crank shaft is 90° into the power stroke, and then decreases throughout the remainder of the power stroke. Thus in crank shaft engines, torque is maximized only at one point and not until the piston is approximately half way into the power stroke.

During the power stroke of the piston, the force transfer means will pivot in one direction from the longitudinal axis of the cylinder. As the piston clears bottom dead center, the force transfer means will be guided through the cylinder center line (but not necessarily simultaneous with bottom dead center) and will pivot in the opposite direction from the longitudinal axis of the cylinder. Thus, opposite sides of the continuous, internally facing force transfer means engage the guide means during the power and return piston strokes. In other words, as the piston reciprocates, the drive means engages the force transfer means at opposite sides.

In addition, those skilled in the art will recognize that since the force transfer means is pivotally mounted to the piston, it is carried along with the piston within the cylinder. Thus, at least a portion of the force transfer means will be carried by the piston into the cylinder as the piston reciprocates. This feature provides an additional space saving advantage.

Thus, for any particular shape of force transfer means, drive means, or combination thereof, the guide means may be designed to provide maximum conversion of rectilinear movement of the piston into rotary movement. Furthermore, the guide means may be positioned at an end opposite to the pivotal end of the force transfer means or drive rack carrying it, or it may be positioned in any convenient location on the force transfer means. Thus, it may be positioned at either side or the back portion of the drive rack. Preferably, the guide means is positioned on the end opposite to the pivotally connected end of a drive rack carrying the force transfer means.

The guide means may be any element which will continuously guide the force transfer means in a path of maximum energy conversion. Preferably, the guide means is a rigid runner or slider mounted by a pin into a runner track. The runner track would have a runner way defined by an interior wall and an outer wall. The interior wall forms the runner guide for the runner or slider. Those skilled in the art will recognize that in order to reduce friction in the runner track, the runner may be allowed to rotate about the runner pin.

By guiding the force transfer means through a substantially linear conversion of the rectilinear movement of the piston into rotary movement, the present invention allows low grade quality fuels to be burned without fuel additives. Auto ignition, detonation or knocking which may occur does not adversely affect the internal combustion engine of the present invention since linear conversion of energy is substantially retained throughout the power stroke of the piston. Thus, elaborate timing mechanisms and the space they required are not necessary. Furthermore, the overall length of the force transfer means is believed to be less than a conventional commercial connecting rod, and therefore additional space may be saved.

DETAILED DESCRIPTION OF THE PREFERRED EMBODIMENTS

Figure 2:
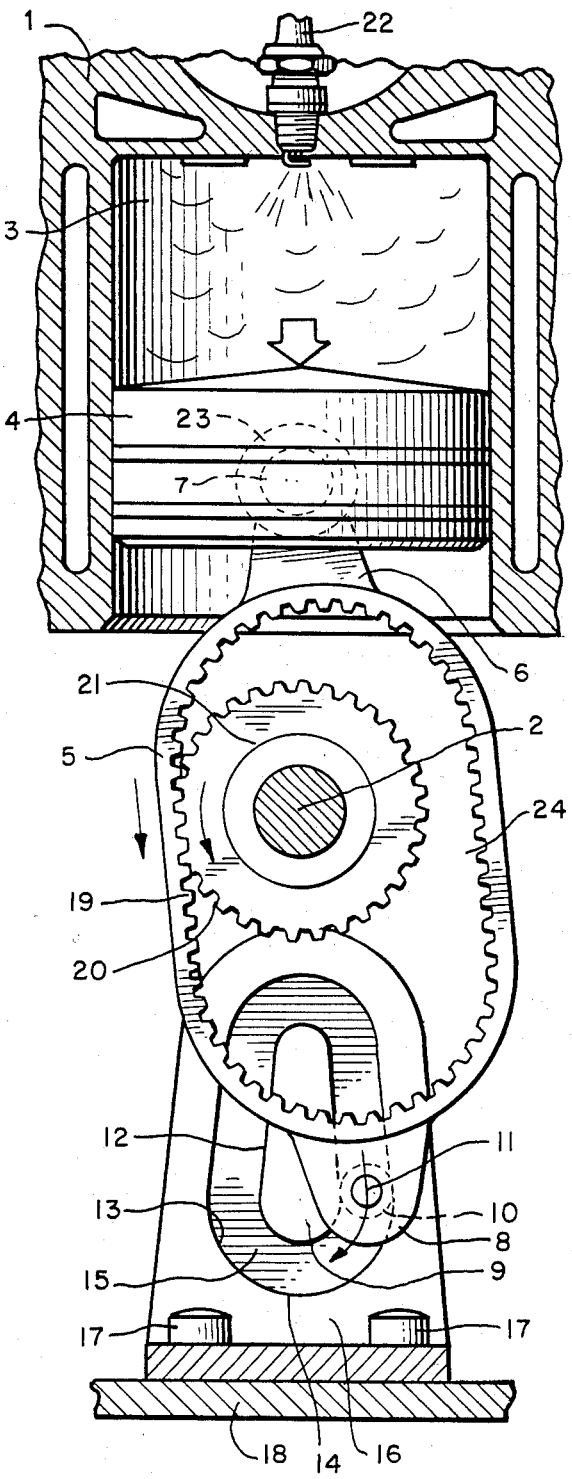
FIG. 2 is a front sectional view of a rack and gear assembly of an internal combustion engine constructed in accordance with the present invention during the power stroke of the piston.
Figure 3:
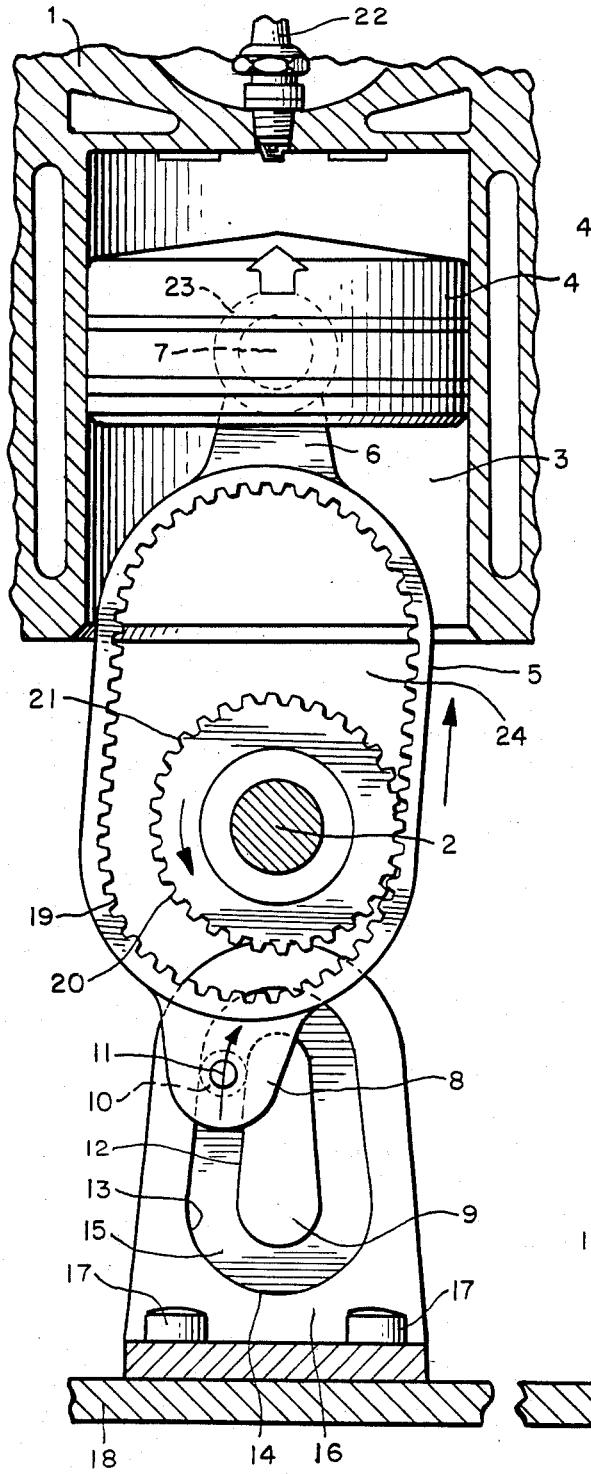
FIG. 3 is a front sectional view of a rack and gear assembly of an internal combustion engine constructed in accordance with the present invention during the return stroke of the piston.

A preferred embodiment of the present invention is illustrated in FIGS. 1, 2 and 3. For simplicity, only a single cylinder engine is depicted. Furthermore, conventional details of an internal combustion engine commonly known to those skilled in art have been excluded Thus, carburetion, valve, ignition, combustion and lubrication systems and the like, may be any conventional design well known to those of ordinary skill in the art. Furthermore, the figures shown are not intended as scale reproductions. Finally, the terms upward, downward, sideward, vertical, and horizontal are intended to represent essentially parallel and/or perpendicular relationships and not intended to be a limitation upon the present invention.

The continuous rack and gear assembly of the present invention will be described for a spark ignition engine. Those skilled in the art, however, will readily understand that the means for initiating fuel combustion is not essential to the invention. Thus, compression ignition of the combustion fuel is also contemplated in the present invention. In the latter embodiment, appropriate fuel injecting devices and accompanying conventional hardware are contemplated. In addition, conventional valve systems commonly employed in the art are contemplated. Thus, it is contemplated that the present invention may be employed in connection with either a two stroke or a four stroke cycle internal combustion engine.

FIG. 1 illustrates an engine block 1 carrying a centrally located rotatable drive shaft 2. A cylinder 3 projecting from the engine block 1 contains a piston 4 which is positioned within the cylinder 3 for reciprocal motion. The piston 4 and cylinder 3 may be construed to define a combustion chamber in the upper portion of cylinder 3 near spark plug 22. Piston 4 is attached to drive rack 5 at pivotal mounting 6 by wrist pin 7. The drive rack 5 may be attached to the piston 4 by any means which will allow pivotal movement of the drive rack 5 at pivotal mounting 6 as piston 4 linearly reciprocates.

Drive rack 5 has an aperture 24 which supports an internally facing, continuous row of drive rack teeth 19. The row of drive rack teeth 19 transmit the rectilinear force from piston 4 to drive gear 21, and may be generally elliptical as indicated in FIG. 1. As discussed in connection with FIGS. 5 and 6, it is to be understood that the exact shape of the row of drive rack teeth 19 is not limited to that illustrated, but may be any other irregular shape which achieves the objective of the present invention. Preferably, the shape of the row of drive rack teeth 19 contains at least one substantially linear segment which is substantially parallel to the longitudinal axis of the cylinder 3, and therefore substantially perpendicular to the longitudinal axis of drive shaft 2.

Drive rack 5 further contains a runner mounting 8. The drive rack 5 engages runner guide 9 by way of runner 10 which is attached to runner mounting 8 with pin 11 which is slidably disposed within runner track 14. The runner guide 9 is defined by the inner wall 12 of runner track 14. Outer wall 13 of runner track 14 is substantially parallel to the inner wall 12 and generally takes the shape of runner guide 9. The distance between inner wall 12 and outer wall 13 of runner track 14 is sufficient to allow runner 10 to be positioned in runner way 15 of runner track 14. Runner track 14 is set in runner block 16 which may be secured by any suitable means such as bolts 17 to a block 18 (which may be engine block 1).

The drive rack teeth 19 mesh with the teeth 20 of rotatable drive gear 21 which is nonrotatably keyed to rotatable drive shaft 2 and thus transmit the rectilinear force of piston 4 to drive gear 21 causing drive gear 21 and drive shaft 2 to rotate. As indicated in FIG. 1, the drive gear 21 is a round shaped element. However, as discussed herein and shown in FIG. 5, any irregular shape such as an elliptical shape may be employed as a drive gear. Thus, any drive gear shape in combination with any shape of drive rack teeth which achieves the objective of the present invention may be employed.

In describing the operation of the engine, reference will be made to FIGS. 1, 2 and 3. In FIG. 1, the rack and gear assembly is shown when piston 4 is at the top of the piston stroke (top dead center). At this point, the assembly is pictured just prior to the power stroke of the piston. The runner 10 is positioned at approximately the top portion of runner guide 9. The drive gear 21 contacts the bottom portion of drive rack teeth 19 such that drive gear teeth 20 mesh with the bottom semi-circular segment of drive rack teeth 19.

Referring to FIG. 2, when an explosion of fuel is created by a suitable explosion means such as a spark plug 22, piston 4 begins a power stroke and moves linearly within cylinder 3 toward drive shaft 2 causing drive rack 5 to move in a generally parallel path with respect to the path of piston 4. As drive rack 5 is powered by piston 4, runner 10 positioned in runner way 15 follows runner track 14 causing drive rack 5 to pivot slightly at pivotal mounting 6 As drive rack 5 is driven, drive rack teeth 19 transmit the rectilinear energy of piston 4 through drive gear teeth 20 and drive gear 21 to keyed drive shaft 2 causing drive shaft 2 to rotate.

Referring now to FIG. 3, as piston 4 reciprocates in the opposite direction of the power stroke, the assembly enters the return phase and runner 10 progresses around the bottom portion of runner guide 9. In the return phase, piston 4 moves in an upward direction carrying drive rack 5 with it. As piston 4 returns to the top of the piston stroke, drive rack 5 is carried with it, and runner 10 following runner track 14 causes drive rack 5 to pivot at pivotal mounting 6. In the return phase, drive rack teeth 19 remain engaged with drive gear teeth 20, maintaining the rotary movement of drive gear 21 and drive shaft 2. When piston 4 returns to the top of the stroke position, runner 10 will be positioned as shown in FIG. 1 ready to repeat another cycle.

Figure 4:
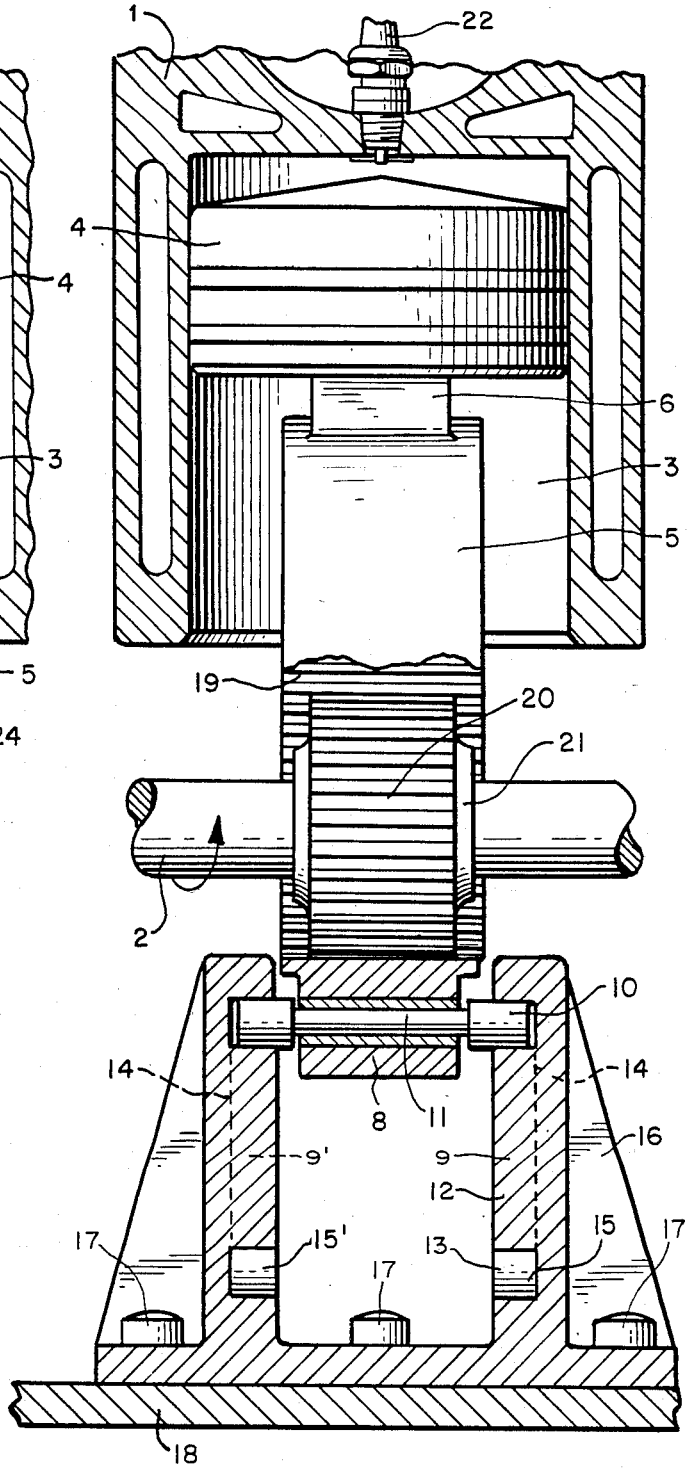
FIG. 4 is a side view of a rack and gear assembly of an internal combustion engine constructed in accordance with the present invention wherein the assembly is about to begin a driving cycle.

FIG. 4 shows a side view of the rack and gear assembly of the present invention wherein the assembly is about to begin a driving cycle. It can be seen that drive rack 5 and thus the force transfer means drive rack teeth 19 carried thereon is substantially planar shaped and the drive rack plane is substantially perpendicular to the longitudinal axis of the drive shaft 2. Drive rack 5 is centrally mounted by way of pivotal mounting 6 attached to piston 4. It is to be understood that any means for pivotally mounting the drive rack 5 to the piston 4 is contemplated by the present invention. A common pivotal mounting means as illustrated in FIG. 1 contains a wrist pin 7 inserted within a bearing 22.

Those skilled in the art will recognize that runner block member 16 may be constructed such that runner 10, which may project from either side of runner mounting 8, will move through runner ways 15 and 15'. Thus, runner block 16 may be constructed to provide two runner tracks 14 and 14' and two runner guides 9 and 9' which are present on either side of drive rack 5. Though the dual runner way embodiment is preferred, those skilled in the art will recognize that runner block 16 need only contain a single runner way which may be runner way 14 or 14'.

It is further to be understood that runner 10 may be either a slider pin or a rotatable bearing. It is only required that runner 10 be able to move freely throughout the runner track.

Figure 5:
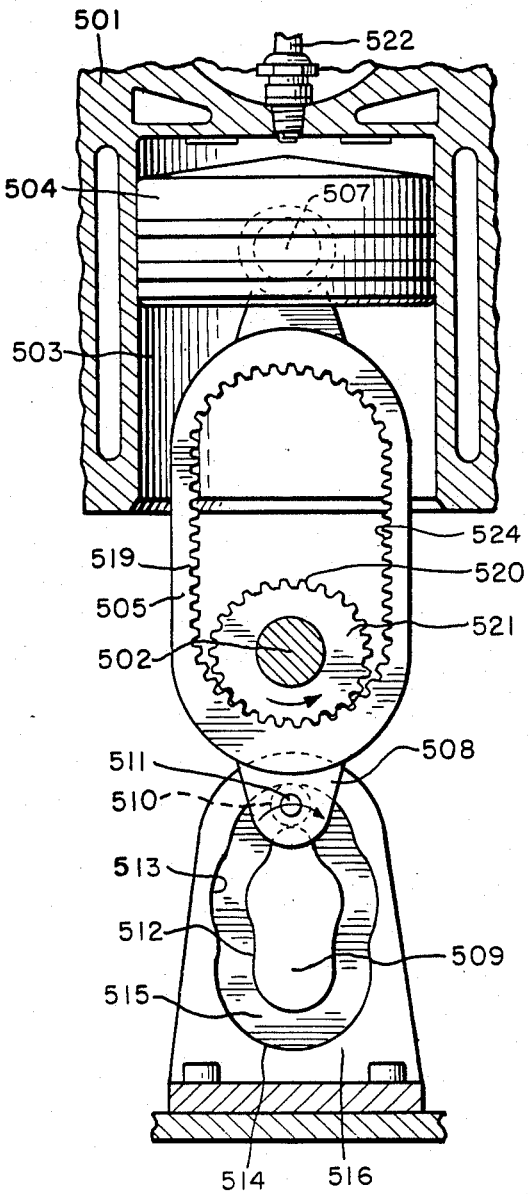
FIG. 5 is a front view of a second embodiment of the present invention employing an elliptical shaped drive gear.

FIG. 5 illustrates a second preferred embodiment wherein an elliptical shaped drive gear 521 is employed in the rack and gear assembly in accordance with the present invention. A major feature of the present invention is to provide maximum conversion of linear energy into rotational energy. Those skilled in the art will recognize that a properly shaped drive means in combination with a properly shaped force transfer means will reduce wasted energy to angular forces in the conversion.

Runner block 516 having runner track 514 set therein shows runner 510 positioned in runner way 515. Runner way 515 is defined by inner wall 512 and outer wall 513. As piston 504 is in the power stroke, runner guide 509 guides drive rack 505 such that drive rack teeth 519 cooperatively associate with elliptical drive means 521 to convert reciprocal rectilinear movement of the piston into rotary movement.

Those skilled in the art will recognize that elliptical shaped gear 521 will be able to provide a variable arm component resulting in a smoother conversion of rectilinear movement of the piston into rotary movement of the drive shaft 502. Thus, contrary to commercial crank shaft engines, a substantially constant maximum torque will be applied to drive shaft 502 substantially throughout the conversion.

Figure 6:
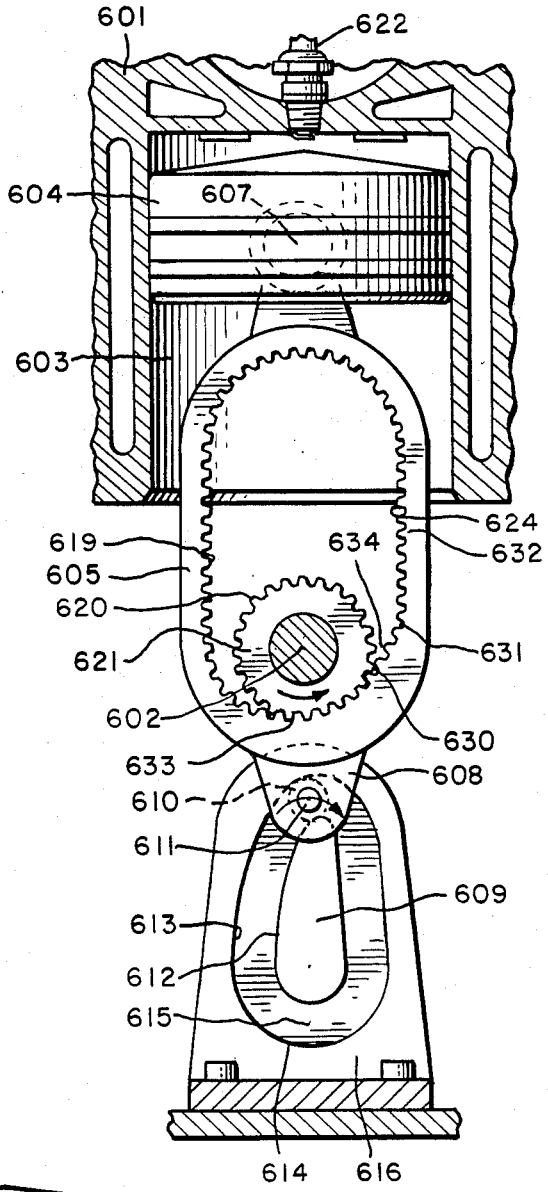
FIG. 6 is a front view illustrating a third embodiment of the present invention employing an irregular shaped row of internally facing teeth

FIG. 6 illustrates a third embodiment in accordance with the present invention where a circular shaped drive gear 621 is employed in an irregular shaped force transfer means defined by drive rack teeth 619 carried by drive rack 605. Those skilled in the art will again recognize that any shaped force transfer means such as drive rack teeth 619 which will reduce the angularity force experienced in converting rectilinear to rotary movement will suffice.

According to generally accepted internal combustion theory, a spark in the combustion chamber occurs before the end, of the compression stroke of a piston such that the greatest force is exerted on the piston near the beginning of the expansion or power stroke. Thus, the timing of fuel inlet and spark ignition is crucial in commercial spark ignited engines. In addition, knocking or detonation may occur as a result of poor timing or variances in the quality of fuel. In order to compensate for these variances, a third embodiment in accordance with the present invention illustrated in FIG. 6 provides for a sloped portion 630 of drive rack teeth 619 on drive rack 605 which at point 631 changes to a substantially linear segment 632. Thus as a spark and a combustion chamber is ignited, the drive wheel 621 will be engaged with the lower portion of drive rack 605 at point 633. As the fuel molecules around and within the spark discharge given by spark plug 622 are being energized to a level where reaction becomes self sustaining, inertia of the piston will cause the drive rack teeth 619 to be engaged with drive gear 621 at a position generally indicated at point 634. Once the reaction in the combustion chamber is well underway, drive rack teeth 619 will engage drive gear 621 in the substantially linear segment 632 which is substantially parallel to the longitudinal axis of the cylinder 603. In this manner, a maximum conversion of the rectilinear energy of the piston 604 into rotary energy is achieved.

Figure 7:
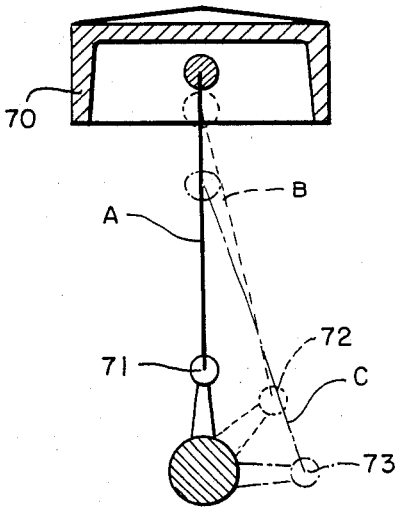
FIG. 7 is a diagram view of the motion of a conventional piston rod and crank shaft assembly.

FIG. 7 is a diagram view of the motion of a conventional piston rod and crank shaft assembly. At position A of FIG. 7, the piston 70 is at the top portion of the stroke. This position where the piston is at or near the upper limit of the stroke is considered a dead or motionless stage and often referred to as the top dead center. The piston is commonly attached by a connecting rod which is journalled to a crank throw on the crank shaft. Top dead center is represented by position A and point 71.

As is commonly known in the art, the main function of the piston is to transmit force created by the combustion process to the connecting rod. The connecting rod cranks the crank shaft in a circular direction thereby converting rectilinear movement to rotary movement. In doing so, the angularity of the path of the crank shaft and connecting rod assembly causes a considerable side thrust to be exerted on the walls of the cylinder. At position B, this angular force may be construed as a vector component perpendicular to the linear direction of the piston during the power stroke, and at point 72, a substantial amount of linear energy is wasted to angular forces. t is only at position C and point 73 where maximum conversion of linear energy to rotary energy is achieved.

Referring now to FIGS. 1 and 2, it can be seen that when the piston 4 begins the power stroke, the drive rack 5 carrying drive rack teeth 19 moves in a direction which is substantially parallel with the longitudinal axis of the cylinder bore. This relationship allows maximum conversion of the rectilinear energy of the piston 4 to rotary energy in the drive shaft 2. Wasted angular forces experienced by the assembly are negligible.

We claim:

1. A crankless internal combustion engine comprising:

(a) a cylinder;

(b) a piston slidably disposed for rectilinear reciprocal movement within said cylinder;

(c) a continuous internally facing force transfer means pivotally mounted to said piston;

(d) a drive shaft;

(e) a drive means keyed to said drive shaft and internally adjacent to said force transfer means, a portion of said drive means engaging a portion of said force transfer means; said drive means and/or said force transfer means being shaped in accordance with the variable forces applied to the piston during rectilinear reciprocal movement of said piston within said cylinder; and (f) means for guiding said force transfer means such that said drive means cooperatively associates with said force transfer means to convert the rectilinear movement of the piston into rotary movement of the drive shaft.

2. The engine of claim 1 wherein said piston and said cylinder define a combustion chamber and said force transfer means is pivotally mounted to said piston on the opposite side from said chamber.

3. The engine of claim 1 wherein said force transfer means is carried by a drive rack which is pivotally mounted to said piston.

4. The engine of claim 1 wherein said force transfer means contains a substantially linear segment.

5. The engine of claim 1 wherein the central longitudinal axis of said drive shaft intersects the central longitudinal axis of said cylinder.

6. The engine of claim 1 wherein said drive means defines a plane substantially perpendicular to the central longitudinal axis of said drive shaft and intersects the central longitudinal axis of said cylinder.

7. The engine of claim 1 wherein said force transfer means is pivotally mounted to said piston such that when said piston reciprocates, said force transfer means is at least partially carried by said piston into said cylinder.

8. The engine of claim 1 wherein said force transfer means is slidably mounted to said guiding means.

9. The engine of claim 8 wherein said force transfer means is slidably mounted to said guiding means with a slider pin.

10. The engine of claim 8 wherein the upper end of said force transfer means is pivotally mounted to said piston and the lower end of said force transfer means is slidably mounted to said guiding means.

11. The engine of claim 1 wherein said guiding means comprises a runner block defining a runner track.

12. The engine of claim 11 wherein said force transfer means is slidably mounted to said runner track.

13. The engine of claim 3 wherein said drive means comprises a drive gear.

14. The engine of claim 1 wherein said force transfer means contains a continuous row of teeth carried by a drive rack.

15. The engine of claim 14 wherein said drive means comprises a drive gear, a portion of which engages said drive rack teeth.

16. The engine of claim 1 wherein the shape of said force transfer means is generally elliptical.

17. The engine of claim 1 wherein the shape of drive means is circular.

18. The engine of claim 1 wherein the shape of drive means is elliptical.

19. The engine of claim 15 wherein the shape of said drive gear is circular.

20. The engine of claim 15 wherein the shape of said drive gear is elliptical.

21. A crankless internal combustion engine comprising:

(a) a cylinder;

(b) a piston slidably disposed for rectilinear reciprocal movement within said cylinder;

(c) a continuous internally facing force transfer means pivotally mounted to said piston and having a substantially linear segment;

(d) a drive shaft;

(e) a drive means keyed to said drive shaft and internally adjacent to said force transfer means, a portion of said drive means engaging a portion of said force transfer means; said drive means and/or said force transfer means being shaped in accordance with the variable force applied to the piston during rectilinear reciprocal movement of said piston within said cylinder; and (f) means for guiding said force transfer means such that during a power stroke of said piston, said drive means engages the substantially linear segment of said force transfer means.

22. A crankless internal combustion engine comprising:

(a) a cylinder;

(b) a piston slidably disposed for rectilinear reciprocal movement within said cylinder;

(c) a continuous internally facing force transfer means pivotally mounted to said piston, said force transfer means being shaped in accordance with the variable forces applied to the piston during reciprocal movement of the piston within said cylinder;

(d) a drive shaft;

(e) a drive means keyed to said drive shaft and internally adjacent to said force transfer means, a portion of said drive means engaging a portion of said force transfer means, said drive means being shaped in accordance with the variable forces applied to the piston during reciprocal movement of the piston within said cylinder; and (f) means for guiding said force transfer means such that said drive means cooperatively associates with said force transfer means to convert the rectilinear movement of the piston into rotary movement of the drive shaft.

23. A crankless internal combustion engine comprising:

(a) a cylinder;

(b) a piston slidably disposed for rectilinear reciprocal movement within said cylinder, said piston and said cylinder defining a combustion chamber;

(c) a continuous internally facing force transfer means pivotally mounted to said piston on the opposite said of said chamber such that when said piston reciprocates, said force transfer means is at least partially carried by said piston into said cylinder;

(d) a drive shaft disposed on the opposite side of said chamber;

(e) a drive means keyed to said drive shaft and internally adjacent to said force transfer means, a portion of said drive means engaging a portion of said force transfer means; said drive means and/or said force transfer means being shaped in accordance with the variable forces applied to the piston during rectilinear reciprocal movement of said piston within said cylinder; and (f) means for guiding said force transfer means such that said drive means cooperatively associates with said force transfer means to convert the rectilinear movement of the piston into rotary movement of the drive shaft.

24. A crankless internal combustion engine comprising:

(a) a cylinder;

(b) a piston slidably disposed for reciprocal movement within said cylinder, said piston and said cylinder defining a combustion chamber;

(c) a drive rack pivotally mounted to said piston on the opposite side from said chamber, said rack carrying a continuous internally facing row of teeth;

(d) a drive shaft;

(e) a drive gear keyed to said drive shaft and internally adjacent to said continuous row of teeth, the teeth of a portion of said drive gear engaging a portion of the teeth of said drive rack; said drive gear and/or said drive rack being shaped in accordance with the variable forces applied to the piston during rectilinear reciprocal movement of said piston within said cylinder; and (f) a runner block defining a closed runner track, said drive rack being slidably mounted to said runner track.

25. A method for converting the rectilinear movement of a piston within a cylinder of a crankless internal combustion engine into rotary movement of a drive shaft, wherein said engine comprises, a combustion chamber defined by said piston and said cylinder, a continuous internally facing force transfer means pivotally mounted to said piston and having a plurality of segments, one of which is substantially linear, and a drive means internally adjacent to and engaged with said force transfer means, and nonrotatably keyed to said drive shaft, said drive means and/or said force transfer means being shaped in accordance with the variable forces applied to the piston during rectilinear reciprocal movement of said piston within said cylinder, said method comprising:

(a) introducing a combustible fuel into said combustion chamber;

(b) combusting said fuel thereby causing said piston and said force transfer means to move away from said combustion chamber, said piston moving rectilinearly in a power stroke;

(c) rotating said drive shaft by guiding said force transfer means during the power stroke of said piston such that said drive means cooperatively associates with said force transfer means to convert the rectilinear movement of said piston into rotary movement of the drive shaft.

* * * * *

UNITED STATES PATENT AND TRADEMARK OFFICE

CERTIFICATE OF CORRECTION

PATENT NO. : 4,803,964

DATED : February 14, 1989

INVENTOR(S) : Wladyslaw Kurek et al.

It is certified that error appears in the above-identified patent and that said Letters Patent is hereby corrected as shown below:

IN THE BACKGROUND OF THE INVENTION

In column 1, line 6, after "engines" please insert --.--.

In column 1, line 51, after "engines" please insert --.--.

In column 1, line 68, after "shaft" please insert --.--.

In column 2, line 4, after "units" please insert --.--.

In column 2, line 11, after "movement" please insert --.--.

In column 2, line 51, after "track" please insert --.--.

In column 3, line 6, after "movement" please insert --.--.

In column 3, line 10, after "parts" please insert --.--.

IN THE SUMMARY OF THE INVENTION

In column 4, line 9, after "piston" please insert --.--.

UNITED STATES PATENT AND TRADEMARK OFFICE

CERTIFICATE OF CORRECTION

PATENT NO. : 4,803,964

DATED : February 14, 1989

INVENTOR(S) : Wladyslaw Kurek et al.

It is certified that error appears in the above-identified patent and that said Letters Patent is hereby corrected as shown below:

IN THE DETAILED DESCRIPTION
OF THE INVENTION

In column 6, line 53, after the second occurrence of "movement" please insert --.--.

In column 7, line 47, please delete "required" and substitute therefor --require--.

IN THE DETAILED DESCRIPTION
OF THE PREFERRED EMBODIMENT

In column 7, line 59, after "in" please insert --the--; and after "excluded" please insert --.--.

In column 9, line 17, after "6" please insert --.--.

In column 10, line 32, after "end" please delete ",".

UNITED STATES PATENT AND TRADEMARK OFFICE

CERTIFICATE OF CORRECTION

PATENT NO. : 4,803,964

DATED : February 14, 1989

INVENTOR(S) : Wladyslaw Kurek et al.

It is certified that error appears in the above-identified patent and that said Letters Patent is hereby corrected as shown below:

In column 11, line 13, please delete "t" and substitute therefor --It--.

IN THE CLAIMS

In column 12, line 22, after the second occurrence of "of" please insert --said--.

In column 12, line 24, after the second occurrence of "of" please insert --said--.

In column 13, line 15, please delete the first occurrence of "said" and substitute therefor --side--.

Signed and Sealed this

Sixth Day of August, 1991

*Attest:*

*Attesting Officer*

HARRY F. MANBECK, JR.

*Commissioner of Patents and Trademarks*